United States Patent [19]

Skerchock et al.

[11] Patent Number: 4,813,331

[45] Date of Patent: Mar. 21, 1989

[54] APPARATUS AND METHOD FOR FILLING INDIVIDUAL MUNITIONS ITEMS WITH EXPLOSIVE

[75] Inventors: Peter Skerchock, Little Falls; Lawrence Honablew, Morristown; Antonio Caldrelli, Dover, all of N.J.; LeRoy D. Cooper, Riverton; Jerry W. Wiseman, Oswego, both of Kans.; Robert L. Brotherton, Carthage, Mo.

[73] Assignee: The United States of America as represented by the Secretary of the Army, Washington, D.C.

[21] Appl. No.: 34,469

[22] Filed: Apr. 6, 1987

[51] Int. Cl.[4] ..... F42B 3/00; C06D 1/08

[52] U.S. Cl. ..... 86/20.12; 86/20.1; 86/20.14; 264/3.1

[58] Field of Search ..... 86/20.12, 20.13, 20.14, 86/20.1, 33, 30; 264/3.1, 3.4

[56] References Cited

U.S. PATENT DOCUMENTS

| | | | |
|---|---|---|---|
| 2,960,000 | 11/1960 | Thomas | 86/20.12 |
| 3,570,364 | 3/1971 | Thibodaux, Jr. | 86/20.12 |
| 3,783,735 | 1/1974 | Murphy et al. | 264/3.2 |
| 3,967,527 | 7/1976 | Dunn et al. | 86/20.12 |
| 4,000,682 | 1/1977 | Thibodaux, Jr. et al. | 264/3.1 |
| 4,009,060 | 2/1977 | Bluhm | 149/93 |
| 4,098,189 | 7/1978 | Holm | 86/20.14 |
| 4,336,209 | 6/1982 | Guldén et al. | 86/20.12 |
| 4,380,186 | 4/1983 | Bührer | 86/20.14 |
| 4,393,014 | 7/1983 | Ziegler | 86/20.12 |
| 4,671,160 | 6/1987 | Kakino et al. | 86/20.1 |

*Primary Examiner*—Howard J. Locker

*Attorney, Agent, or Firm*—Robert P. Gibson; Edward Goldberg; Edward F. Costigan

[57] ABSTRACT

Apparatus and method are provided for stirring an explosive materials mixture maintained in a molten state to ensure homogeneity of its composition and for transfer of predetermined quantities thereof, by transfers primarily in a horizontal direction, via a positive displacement piston/cylinder system and a pneumatically controlled spool valve for injection into a munitions item through a detachable intermediate element that serves as a temporary riser. An explosive material mixture, containing a molten component and particulate matter which would otherwise precipitate out, is thus delivered in a homogeneous form into an individual munitions item of arbitrary shape and size in an amount controlled to ensure safe and adequate filling of the munitions item, the provision of a small surplus of material to accommodate shrinkage during cooling of the filled explosive material, and limiting the amount of riser scrap that must be collected and disposed subsequent to each such filling.

6 Claims, 3 Drawing Sheets

APPARATUS AND METHOD FOR FILLING INDIVIDUAL MUNITIONS ITEMS WITH EXPLOSIVE

TECHNICAL FIELD

This invention relates generally to an apparatus and a method for filling individual munitions items with explosive material and, more particularly, to apparatus and methods for forcibly injecting into an empty munitions item a controlled quantity of an explosive mixture of a meltable component and a particulate component.

BACKGROUND OF THE INVENTION

A large variety of munition items, e.g., anti-armor cluster munitions (ACMS) are formed with a cavity that is filled with a specific amount of explosive material during manufacture. Until recently, one conventional technique was to melt an amount of explosive material such as 70/30 Cyclotol or 60/40 Comp B explosive in a "kettle" and then have it poured into the empty munitions item, with provision for a certain amount of the explosive material to form a riser after the item is filled. As the poured explosive material cools within the munitions item it experiences some shrinkage and draws in some of the still molten material from the riser. Eventually the riser material is knocked off and collected for reuse or disposal. This technique is both wasteful and somewhat dangerous. The amount of riser material that is scrapped for each munitions item filled often is as high as 200%, and riser scrap as high as 270% has been experienced. Naturally, this represents a waste of product and energy and carries with it an inherent danger of accidents as the scrap has to be collected manually and transferred back to the kettle for remelting. Also, because the method requires much personal handling by relatively skilled operators it is both slow and expensive.

Initial experiments aimed at developing apparatus and methods for injection loading of molten explosive employed a vertical downward dispensation of a controlled volume of molten explosive into a munitions item held in a vertical attitude, somewhat similar to the action of a vertically held hypodermic syringe used by a doctor to inject a fluid into a body part. The particulate HMX had a tendency to settle out in front of the discharge valve in this apparatus and caused intermittent clogging of the valve. Thus, while this solution is capable of reducing riser scrap to approximately 10% with explosives such as 70/30 Cyclotol or 60/40 Comp B, it is unsuitable for use with a viscous explosive like Octol which is normally mixed with the particulate component HMX. Thus, although this technique results in a significant reduction in riser scrap, and has generated associated benefits, it is not suitable for use with certain explosives.

Further research and development led to the development of the apparatus and method of the present invention, which provides a user the facility to inject a controlled amount of virtually any meltable explosive, including mixtures containing particulates, into individual munitions items quickly, efficiently, and with the production of only a minimal amount of riser scrap.

DISCLOSURE OF THE INVENTION

It is an object of this invention to provide a controlled amount of a meltable explosive material to fill an individual munitions item.

It is a further object of this invention to provide apparatus for the filling of individual munitions items with controlled amounts of a meltable explosive containing a particulate component.

It is an even further object of this invention to provide apparatus for the filling of individual munitions items with controlled amounts of a melted explosive mixture containing a particulate component with only a very small amount of explosive material turning into riser scrap.

It is a related object of this invention to provide a method for filling an individual munitions item with a controlled amount of a meltable explosive material.

It is another related object of this invention to provide a method for filling individual munitions items with controlled amounts of a meltable explosive material containing a particulate component.

It is yet another related object of this invention to provide a method for filling individual munitions items with a meltable explosive containing a particulate component with only a very small proportion of the explosive material turning into riser scrap.

These and other objects of this invention are realized by providing an apparatus that maintains a quantity of explosive material, which may contain a particulate component, in a molten state, and simultaneously stirring the explosive material within a heated container to ensure its homogeneity while individual munitions items are being filled therewith. Means for stirring the molten explosive material are deployed to ensure, in particular, that there is no clogging by a particulate component of a delivery aperture in the container controlled by a pneumatically operated valve. This valve communicates with a positive displacement piston mechanism, which receives a controlled quantity of the stirred molten explosive material for forcible injection thereof through a temporary material guiding element having a riser into the interior of an individual munitions item, the explosive material being displaced primarily horizontally in and out of the piston mechanism. In one aspect of the invention, the actuation of the stirrer motor, the flow regulating valve and the positive displacement piston are all effected pneumatically, thus avoiding the placement of electrical lines and equipment in the vicinity of the molten explosive.

The preferred method for using this apparatus includes the steps of maintaining a meltable explosive in a molten state, stirring it while in said molten state to ensure its physical homogeneity, withdrawing a predetermined amount of the stirred homogeneous molten explosive and then forcibly injecting it, through primarily horizontal displacements of the same, into the interior of an individual munitions item.

Still other objects and advantages of the present invention will become readily apparent to those skilled in this art from the following detailed description, wherein only the preferred embodiments of the invention are shown and described, simply by way of illustration of the best modes contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

DESCRIPTION OF THE PREFERRED EMBODIMENTS

Many explosive materials suitable for use in anti-armor cluster munitions and the like can be rendered molten at temperatures just below the boiling point of water, i.e., in the range 200 to 210° F. Certain explosive compositions like Octol contain a particulate component HMX, so that when the mixture is heated it has the texture of a viscous slurry. To prevent precipitation of the particulate component of such an explosive mixture, it is necessary to continually stir the molten mixture.

Figures 1, 5, 6:
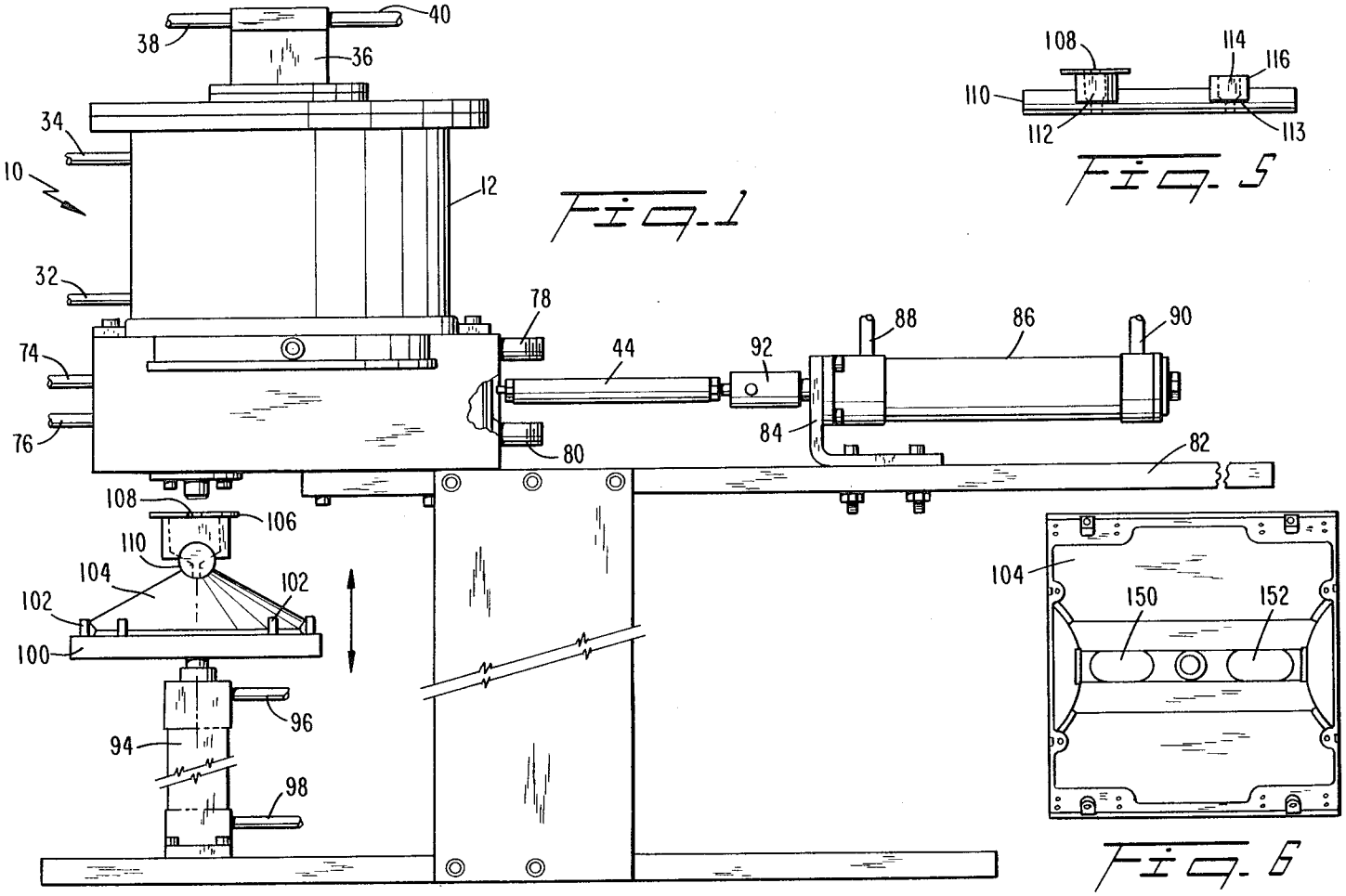
FIG. 1 is a vertical elevation view of a preferred embodiment of the apparatus of this invention.
FIG. 5 is a side elevation view of a fixture for conveying molten explosive material into a munitions item being filled.
FIG. 6 is a plan view of a typical munitions item fillable by the invention.
Figure 2:
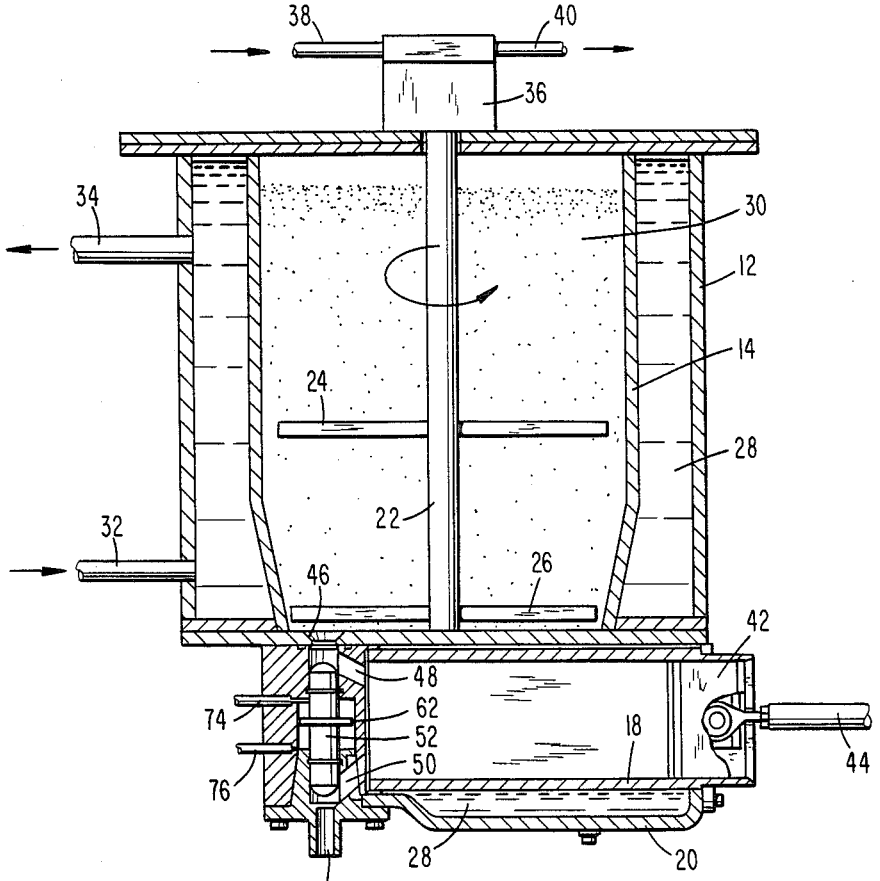
FIG. 2 is a vertical cross-sectional view of a portion of the preferred embodiment of the apparatus of FIG. 1.

The apparatus 10 of a preferred embodiment of the present invention is provided with a double-walled container having an outer generally cylindrical wall 12, seen in exterior view in FIG. 1 and in vertical cross-sectional view in FIG. 2. Referring now to FIG. 2, the inner compartment defined by wall 14 is filled with the explosive material 30. The annular space formed between the outer wall 12 and inner wall 14 is filled with a continually replenished supply of hot water 28 entering through inlet 32 and leaving through outlet 34 in a controlled flow at a controlled inlet temperature. The explosive material 30 is therefore surrounded by and contained within a zone filled with hot water 28 maintained at a predetermined temperature high enough to keep explosive material 30 molten.

A pneumatically actuated rotary air motor 36, provided with an inlet pipe 38 supply compressed air and an air exhaust pipe 40, is mounted on a cover supported by cylindrical wall 12 and has a vertically downwardly depending shaft 22 provided with stirring paddles 24 and 26. Stirring paddle 26 is located very close to the bottom of the explosive container and, during operation, periodically sweeps past a tapered aperture 46 in the floor of the explosive containing space to positively counter any tendency for the particulate component from precipitating out of the stirred molten explosive mixture. The temperature and the rate of flow of hot water 28 in the water jacket surrounding the explosive material 30 are monitored and controlled by conventional means.

Figure 3A:
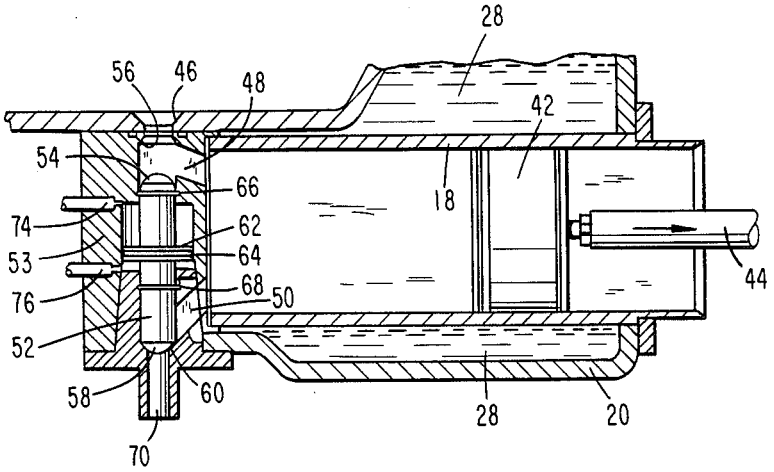
FIGS. 3*a* and 3*b* are vertical cross-sectional views of the positive displacement and control valve portions of the preferred embodiment of this invention.
Figure 3B:
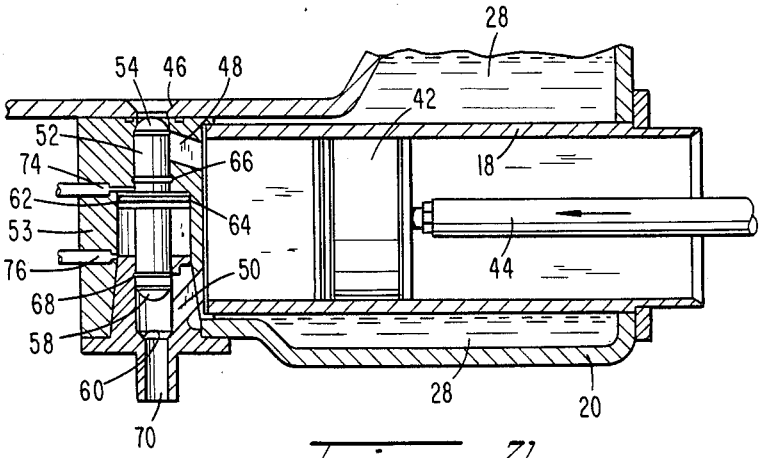

Referring now to FIGS. 3*a* and 3*b*, spool valve 52 is slidingly supported within housing 53 mounted directly beneath aperture 46 in the explosive container. The movable portion of spool valve 52 has a smaller diameter length with a short, central, larger diameter annular flange 62. Housing 53 is provided with O-ring seals 66 and 68 that act to seal around the smaller diameter portion of spool valve 52. Flange portion 62 of the spool valve is provided with a second sealing O-ring 64 that seals against a correspondingly large diameter annular portion within housing 53.

Spool valve 52 is free to move in a vertical direction, and such motion is controlled and actuated by compressed air supplied through either supply port 74 or supply port 76 at the upper and lower ends, respectively, of the larger diameter annular space within housing 53 that seals around flange portion 62 sliding therewithin. Spool valve 52 has generally rounded ends, 54 at the top and 58 at the bottom. Housing 53 is provided with a chamfered aperture 56 at its upper end, communicating with opening 46 of the explosive container thereabove, and a similar chamfered aperture 60 at its lower end. Housing 53 also has a short, virtually horizontal passage 48 at its upper end immediately adjacent to aperture 56, and a similar passage 50 immediately adjacent lower aperture 60.

Apertures 48 and 50 of valve housing 53 communicate with one end of a horizontal cylinder 18, surrounded by a hot water jacket 20. As best seen in FIGS. 3a and 3b, cylinder 18 is fitted with a sliding piston 42 actuated by a connecting rod 44.

Referring now to FIG. 1, connecting rod 44 is coupled by coupling 92 to a pneumatic cylinder 86, of conventional type, provided with attachments 88 and 90 to receive compressed air at either side. The admission of compressed air through either 88 or 90 into pneumatic cylinder 86 forcibly actuates connecting rod 44 to move piston 42 either away from or toward the valve housing while sealingly guiding the piston within cylinder 18. A volume adjustment nut 89 at the right end of 86 is used to set the amount of travel of 44.

As persons skilled in the art will appreciate, pneumatic actuation of piston 42 to the right in FIG. 3a, while spool valve 52 is actuated to be in its lowest position, will, in effect, suck stirred molten explosive mixture through openings 46, 56 and 48 to fill the cylindrical space in front of piston 42. Such a controlled motion of piston 42 away from the valve housing, therefore, serves to charge cylinder 18 with a predetermined quantity of stirred molten explosive which enters cylinder 18 primarily in a horizontal direction.

As best seen with reference to FIG. 3*b*, actuation of spool valve 52 to move it to its uppermost position seals off the explosive container thereabove and opens passage 50 to allow the expulsion of the charge of stirred molten explosive within cylinder 18. By controlled actuation of pneumatic cylinder 86, connecting rod 44 is moved to the left, as best seen in FIG. 3*b*, so that the front face of piston 42 forcibly acts on the charge of stirred molten explosive contained within cylinder 18, moving the same primarily in a horizontal direction, to expel it forcibly through aperture 60 of valve housing 53, to direct the same downwardly through a short injection nozzle 70 having a generally tapered lower end.

Referring now to FIG. 1, the water-jacketed molten explosive container 12, mounted above spool valve housing 53, and the positive displacement mechanism (comprised of cylinder 18, piston 42, and pneumatic cylinder 86) are all conveniently mounted on a level support surface 82. Connections 78 and 80 are utilized to provide hot water flow into and out of the water jacket surrounding cylinder 18 and bracket 84 is utilized to mount pneumatic cylinder 86 to surface 82. It will be understood that in an actual working environment, with possible drafts during cold weather, there may be a tendency for a charge of initially molten explosive to congeal within cylinder 18 and, therefore, hot water is provided to hot water jacket 20 to maintain cylinder 18 and its contents at a suitable high temperature to maintain the explosive in its molten state.

Located below delivery nozzle 70, to lift a munitions item 104 into engagement therewith, is a pneumatically actuated cylinder 94, provided with air connections 96 and 98, which acts to move a work table 100 in a vertically upward or downward direction as needed. The top of work table 100 is provided with indexing extensions 102, preferably around its periphery, shaped to positively and securely locate a munitions item 104 placed in contact therewith. Munitions container 104 which is to receive the stirred molten explosive has two small apertures 150 and 152 at its top which communicate with an intermediate filling fixture 110 and an injector-connecting adapter plate 106 thereabove. Fixture 110 and plate 106 are placed by the operator of the apparatus, as indicated in FIG. 1, on top of the individual munitions item 104 that is to be filled with explosive. As indicated in FIGS. 1 and 5, plate 106 is provided with an aperture 108 shaped and sized to receive nozzle element 70 when the munitions item 104 is lifted upward by pneumatically actuated cylinder 94. Fixture 110 is provided with two cylindrical passages 112 and 113 having tapered bottoms. As persons skilled in the art will immediately appreciate, when a munitions item 104 provided with fixture 110 thereabove, as indicated in FIG. 1, is lifted to communicate with nozzle 70, nozzle 70 closely fits into aperture 108 of plate 106 and makes available a conduit for stirred molten explosive, positively displaced from cylinder 18, to flow into the interior of munitions item 104 via openings 112 and 150.

As munitions items 104 fills up, displaced air rises out of opening 152 and through opening 114 in the riser portion 116 of fixture 110. The air is eventually totally replaced by molten explosive material, enough of which is supplied to rise into and partially fill riser 116. The filling process being thus completed, the work table 100 is lowered and munitions item 104, with fixture 110 on it, is removed to cool down. Some of the explosive material held in riser 116 may be sucked into the munitions item 104 as its explosive material contents cool and shrink.

It will be appreciated that the presence of electrical wiring, electrical motors with the possibility of occasional sparks, or any objects that attain significantly high temperatures during their operation or use are highly undesirable in an environment that contains quantities of an explosive material. It is therefore highly preferable and, in fact, most convenient, to operate devices such as motor 36 to stir the explosive material, spool valve 52 to control the flow of explosive material, piston 42 to positively displace explosive material, and air cylinder 94 to lift work table 100 to properly locate the munitions item to receive explosive material, all by means of compressed air delivered in controlled amounts and at predetermined pressures to effect the necessary motions.

Figure 4:
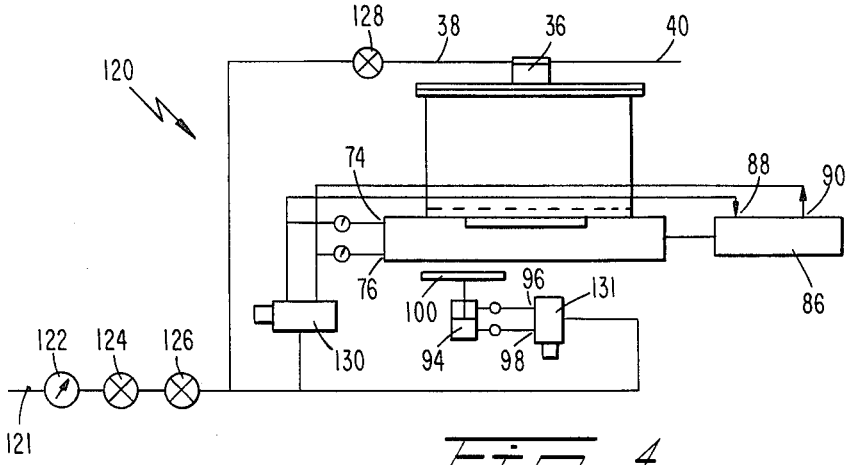
FIG. 4 is a schematic diagram illustrating the layout of compressed air lines to pneumatically actuate various elements of the combinations of a preferred embodiment of this invention.

As best seen in FIG. 4, the principal compressed air supply line 121 is conveniently provided with a pressure sensor 122, a high pressure relief valve 124 and a manually operable lockout valve 126 prior to branching of the compressed air line to individual elements of the apparatus. A separate valve 128 may be provided in line 38 that conveys compressed air to stirrer motor 36 from which exhausted air is released through line 40. Inlets 74 and 76 of valve body 53, 88 and 90 of pneumatic cylinder 86, and 96 and 98 of pneumatic cylinder 94 are all connected to the compressed air supply line as schematically shown in FIGS. 4. Separate manually operable lockout controls 130 and 131 are provided to ensure safe operation of pneumatic cylinders 86 and 94 respectively. Compressed air cylinders to provide reciprocal motion at a controlled rate are well known in industry and it is believed that persons skilled in the art are able to readily select appropriate valves, connections, and the necessary fittings to effectuate safe and efficient operation of the various elements combined in the apparatus of this invention.

The basic manner of operating the apparatus is as follows. A quantity of solid or premolten explosive material 30 is deposited within the explosive containment chamber defined by wall 14, typically in amounts sufficient to fill a batch of munitions items. Hot water 28 is provided at a controlled rate and temperature to generate and maintain a hot environment around the explosive material to cause it to become molten and to stay molten during the filling process. Pneumatic motor 36 is actuated and operated at a controlled speed, to stir the molten explosive material and to maintain it in a stirred condition to ensure that there is no precipitation of any particulate components of explosive material 30. It will be understood that during this process of preparing the explosive material for filling, spool valve 52 is at its uppermost position to prevent any egress of the molten material through aperture 46.

A controlled hot water flow, preferably at a temperature comparable to that of water jacket 28, is provided and maintained through hot water jacket 20 surrounding cylinder 18. Thus, in the preparatory stages, not only is the explosive material melted or added premelted and stirred to obtain homogeneity of the mixture but cylinder 18 and piston 42 are simultaneously heated to receive and handle the explosive in its molten state. Initially, therefore, spool valve 52 will be in its uppermost position and piston 42 will be to its extreme leftward travel so as to be close to valve body 53.

An empty munitions item 104 is then mounted to work table 100, and fixture 110 and plate 106 mounted thereon by the operator to create an essentially funnel-like conduit to convey molten explosive via opening 150 into the interior of the munitions item 104. When it is determined that the molten explosive is ready to be filled into the munitions item 104, the operator actuates pneumatic cylinder 94 to lift work table 100 and firmly hold fixture 110, under plate 106, under nozzle 70, to receive molten explosive 30 therefrom. Note that adaptor plate 106 may be left in place around nozzle 70 as successive munitions items 104 are brought thereunder, each with an individual fixture 110.

Valve 52 is then actuated to move to its lowermost position and piston 42 is moved rightward to its most distant position with respect to valve body 53, in the process sucking in stirred molten explosive, primarily in a horizontal direction, to fill cylinder 18. Valve 52 is then actuated to move to its uppermost position, thus sealing off any further inflow of molten explosive into cylinder 18 and, simultaneously, opening passage 50 for the delivery of explosive material through nozzle 70. Piston 42 is then moved to the left, i.e., toward valve body 53, to forcibly and primarily horizontally expel stirred molten explosive downward through short nozzle 70 and via plate 106 and fixture 110 into the interior of munitions item 104.

The precise amount of explosive material required to fill a given munitions item will, of course, be a known factor controlled by volume adjustment nut 89. Likewise, since the interior diameter of cylinder 18 will be a known factor, the operator will know precisely how much travel must be provided to piston 42 to ensure that the correct amount of explosive is delivered to munitions item 104. It is a well known fact that a molten explosive will shrink somewhat as it cools, wherefore the operator will allow for a certain excess of explosive material to be delivered by piston 42 to accommodate for such shrinkage and to allow for a minimal excess in the riser 116 provided in fixture 110.

As persons skilled in the art will appreciate, a single delivery stroke of piston 42 must be controlled to provide a volume of stirred molten explosive to fill munitions item 104 and provide sufficient excess material to partially fill the funnel like riser 116. When the delivery stroke of piston 42 is thus completed, the operator actuates pneumatic cylinder 94 to lower table 100 to allow removal of munitions item 104 for the transfer thereof to a suitable place where it may cool without disturbance. Element 106, unless it is held around nozzle 70, e.g., by clamping or otherwise in any convenient manner, is conveniently removed at this time for use with the next munitions item to be filled. As the heated molten explosive within munitions item 104 cools and experiences a slight decrease in volume, some of the surplus material contained within riser 116 will be sucked into munitions item 104. Eventually, when the munitions item has cooled sufficiently, an operator will lift off fixture 110 with a small residue of explosive material within it and make munitions item 104 available for the installation of a fuse or other actuating element to seal in its explosive contents.

As previously mentioned, experimental studies have shown that when stirred molten explosive mixtures are moved primarily in a horizontal direction in the process of filling a munitions item, there are no problems with the precipitation of particulate components from the bulk of the molten explosive material. The apparatus and method of this invention utilize this knowledge and deliberately ensure that the primary motion of the molten explosive from supply to the munitions item is essentially in the horizontal direction and that any vertical transfer motions are maintained to a minimum. As is well known, pneumatically actuated mechanisms are commercially available to move promptly and safely and in synchronization with each other with the utilization of well known controls. They are, therefore, highly suitable and safe to provide the necessary motions to practice this invention.

It will be appreciated that both the apparatus and the method are very versatile and provide the facility to fill individual munitions items of a variety of shapes, sizes and capacities on a one-by-one basis. Small volume munitions items will be filled with short strokes by piston 42 and short items will require commensurately long upward travel, by work table 110, as persons skilled in the art will readily appreciate. The apparatus and method as disclosed herein are, therefore, extremely suitable for research facilities and small manufacturing establishments which may deal with small numbers of a variety of munitions items. It will also be understood that if there is a surplus of a particular explosive material left after the filling of munitions items, normal actuation of valve 52 and piston 42 can be employed to completely discharge the explosive container, with the surplus explosive material delivered through nozzle 70 for removal and storage thereof.

A principal advantage of the apparatus and method according to the preferred embodiment of this invention is that the amount of surplus explosive material left after the filling of an individual munitions item is extremely small and is contained primarily within a riser 116 of fixture 110 that is convenient to handle and clean, thus reducing risks while facilitating rapid operation of a munitions filling activity.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. Apparatus for positively injecting an explosive material into a munitions element, comprising:

means for maintaining a quantity of explosive material in a molten state;

means for stirring said explosive material maintained in a molten state;

spool valve means, operably connected directly below said maintaining means, for controlling transfer of a predetermined amount from said quantity of stirred molten explosive material, said valve means having a first and a second operating position;

positive piston displacement means, operably connected to said valve means, for receiving said predetermined amount of stirred molten explosive material through said valve means in said first operating position and thereafter positively displacing said predetermined amount through said valve means in said second operating position, for positive injection of said predetermined amount of stirred molten explosive into said munitions element;

means, temporarily located intermediate said positive displacement means and said munitions element, for guiding said molten explosive material into said munitions element and providing a small-volume temporary riser to hold some of said injected molten material to accommodate for shrinkage of said injected molten material cooling within said munitions element after said positive injection therein; and pneumatic means for controlling the operation of said stirring means, said valve means, and said positive displacement means.

2. Apparatus according to claim 1, wherein:

said positive displacement means is disposed such that any physical motion of said predetermined amount of stirred molten explosive material into and out of said positive displacement means is primarily in a horizontal direction.

3. Apparatus according to claim 1, wherein:

said explosive material comprises a mixture of a meltable component and a particulate component; and said maintaining means and said stirring means coact to ensure that said particulate component is thoroughly mixed with said meltable component and does not precipitate during use of said apparatus.

4. Apparatus according to claim 1, wherein:

said maintaining means comprises a hot-water jacket surrounding said quantity of explosive material to maintain the same in a molten state.

5. Apparatus according to claim 1, wherein:

said positive displacement means comprises a piston reciprocating inside a cylinder.

6. Apparatus according to claim 1, further comprising:

detachable conduit means, intermediate said valve means and said munitions element, for defining a temporary riser space communicating with said molten explosive injected into said munitions element.

* * * * *